US008016733B2

(12) United States Patent
Kim

(10) Patent No.: US 8,016,733 B2
(45) Date of Patent: Sep. 13, 2011

(54) LIGHTWEIGHT, SMALL DIAMETER PAINT ROLLER

(76) Inventor: Song Kim, Rancho Palos Verdes, CA (US)

( * ) Notice: Subject to any disclaimer, the term of this patent is extended or adjusted under 35 U.S.C. 154(b) by 465 days.

(21) Appl. No.: 12/255,958

(22) Filed: Oct. 22, 2008

(65) Prior Publication Data

US 2009/0105058 A1 Apr. 23, 2009

Related U.S. Application Data

(60) Provisional application No. 61/000,251, filed on Oct. 23, 2007.

(51) Int. Cl.
*B05C 17/02* (2006.01)

(52) U.S. Cl. ..... 492/17; 492/47; 492/60; 15/176.5; 15/176.6; 15/230.19; 29/895.2; 29/895

(58) Field of Classification Search ..... 492/17, 492/47, 60; 29/895.2, 895; 15/176.5, 176.6, 15/230.19; *B05C 17/02*
See application file for complete search history.

(56) References Cited

U.S. PATENT DOCUMENTS

| | | | | |
|---|---|---|---|---|
| 2,747,210 | A * | 5/1956 | Canning et al. | 15/230.11 |
| 3,060,555 | A * | 10/1962 | Kirshenbaum et al. | 492/19 |
| 3,745,624 | A * | 7/1973 | Newman | 492/19 |
| 3,877,123 | A * | 4/1975 | Pharris | 492/19 |
| 4,209,883 | A * | 7/1980 | Hawk | 492/19 |
| 4,985,959 | A | 1/1991 | Lieberman et al. | |
| 5,210,899 | A * | 5/1993 | Goldstein et al. | 15/230.11 |
| 5,269,039 | A | 12/1993 | Isaac | |
| 5,613,265 | A | 3/1997 | Gemmell | |
| 5,619,769 | A * | 4/1997 | Hutt | 15/230.11 |
| 6,510,579 | B1 * | 1/2003 | Gartner | 15/230.11 |
| 6,851,155 | B2 * | 2/2005 | Dove | 15/230.11 |
| 6,928,689 | B2 * | 8/2005 | Dove | 15/230.11 |
| 7,120,963 | B2 | 10/2006 | Kim | |
| 2003/0126711 | A1 * | 7/2003 | Korenevsky | 15/230.11 |

FOREIGN PATENT DOCUMENTS

DE 3714415 A1 * 11/1988

* cited by examiner

*Primary Examiner* — Gary L Welch
*Assistant Examiner* — Jason Vaughan
(74) *Attorney, Agent, or Firm* — Berliner & Associates

(57) ABSTRACT

A novel paint roller "cage" having improved tracking and ease of use is adapted for receiving different length axle shafts of various sizes of paint roller frames. An outer tubular support, upon which a paint roller cover or other paint absorbing material may be mounted, contains a pair of support bearings secured at either end of an inner tubular chassis, with one support bearing at a first end of the outer tubular support, and the other support bearing at approximately its mid point. The two support bearings are connected by an inner tubular chassis, which both maintains the two bearings at a desired axial spacing and also holds the walls and radial bearing surfaces of a bushing chamber that is integrally molded with each support bearing in proper position about a tubular bushing that is adapted to be frictionally secured to the axle shaft. In one embodiment, the outer tubular support has a diameter of about 1" and a length of about 9", and can be used with both 6.5" and 9" roller frames. The nominal axial clearance between the tubular bushing and the adjacent radial bearing surfaces of the bushing chamber is less than about 0.005".

7 Claims, 1 Drawing Sheet

LIGHTWEIGHT, SMALL DIAMETER PAINT ROLLER

CROSS-REFERENCE TO RELATED APPLICATION

This application claims priority of Provisional Patent Application No. 61/000,251, filed Oct. 23, 2007, which is incorporated herein in its entirety.

FIELD OF THE INVENTION

The present invention relates generally to an apparatus for painting and in particular to a lightweight, small diameter paint roller cage assembly.

BACKGROUND OF THE INVENTION

Lieberman et al., U.S. Pat. No. 4,985,959 discloses, in FIGS. 1 and 3 though 5, end supports for a paint-applying cover sleeve of a paint roller assembly, each support containing a split tube bushing adapted to receive the metal axle of a paint roller handle (or "frame"). The bushing is frictionally retained on the axle and rotates within a cylindrical chamber defined in the end support.

Isaac U.S. Pat. No. 5,269,039, in FIGS. 2 through 5, discloses a sectional paint roller cover bearing assembly (or "cage") having an end piece that surrounds a split sleeve which acts as a bushing. However, the bushing of Isaac is only retained by the end piece after either an extension or an end cap is inserted into the end piece. Several extensions may be used to form a longer roller assembly for supporting a longer cover, and a second bushing may be disposed in one of the extensions; however the only bearing surfaces for facilitating rotation of the roller on the axle of the roller frame are at the two ends, in the end piece and in the end cap.

Goldstein U.S. Pat. No. 5,210,899 discloses a paint roller cage, seen in FIGS. 1, 5, 7, and 9, having a series of offset or staggered outer semi-cylindrical surfaces that frictionally engage the interior of a small diameter paint roller cover sleeve. At least one bushing loosely fits within the confines of one of the semi-cylindrical chambers of the bearing and clamps around the metal axle of the paint roller handle. Except for an end cap at one end, each bearing surface is not cylindrical, but is defined by a pair of adjacent reduced diameter semi-cylindrical surfaces at each end of each semi cylindrical chamber. Goldstein makes no special provision for accurate rotation and lateral positioning of the bearing assembly about the axle, and it would appear from FIG. 10, that when the removable cover is not secured to the bearing assembly, Goldstein's bushings can easily fall out of the cylindrical chambers.

In Song Kim U.S. Pat. No. 7,120,963 there is disclosed a paint roller cage in the form of a cylindrical sleeve having a diameter of about 0.25" to 1.0", upon which the paint receiving cover material may be mounted, and into one end of which a single molded support bearing is inserted, the single support bearing having a first cylindrical chamber adapted for supporting the axle portion of the paint roller handle, typically a metal rod, and a second chamber coaxial with the first for receiving a single split bushing having an nominal internal diameter less than the diameter of the metal rod of the paint roller handle, with the dimensions of the second chamber being such that the bushing may rotate freely inside the second chamber, but is somewhat constrained longitudinally. The second chamber has a large lateral opening through which the split bushing may be inserted into the second chamber prior to insertion of the support into the sleeve. The inner surface of the sleeve functions as a cover for the lateral opening after the support and bushing have been inserted.

A traditional paint roller cover with a 0.5" nap has a diameter of 1.5" and a length of 9", and with a conventional cage and frame weighs about 0.85 lbs, or fully loaded with paint weighs about 1.8 lbs. Moreover, traditional roller covers have lateral movement along the axle on average of 0.25" resulting in walk off from the frame.

Simply reducing the length of a standard roller to reduce its weight results in a loss of efficiency in that more strokes are needed with shorter rollers to paint a given surface. Similarly, use of a standard length cover on a shorter frame results in asymmetric forces being applied to the cover and exacerbates the tendency of the rotating cover to deviate from the proper alignment with the frame. Therefore there is a need for a lightweight paint roller of standard length that can be used with a shorter and smaller frame but that nevertheless still maintains a proper alignment between the cover and the frame, thus facilitating precise and even coverage of the surface to be painted.

SUMMARY OF THE INVENTION

The present invention provides for a paint roller cage or the like which has all the advantages of the prior art with similar outer dimensions and paint loading capacity, with improved mechanical properties but easier and less tiring to use. In particular, the present invention makes it possible to mount a novel lightweight roller with the same dimensions as the previously mentioned traditional paint roller cover onto a shorter frame, with better tracking and smoother rotation than has heretofore been possible. When loaded with paint, the new paint roller assembly (including cover, cage and frame) weighs only about 1.08 lbs, a 40% weight reduction compared to traditional paint roller assemblies. In addition, the present invention provides a roller cover assembly containing a precisely dimensioned (preferably within a tolerance of 0.002" in the axial dimension) bushing chamber for constraining axial movement of an internal bushing that is frictionally secured to the axle portion of the roller frame, so that the roller cover has only limited axial movement (typically in the range of 0.002" to 0.005") and does not walk off.

In accordance with one aspect of the present invention, the cover and cage portions are preferably integrated in a disposable light weight assembly which can be easily and quickly assembled by unskilled labor from relatively inexpensive components.

In accordance with yet another aspect, the mounting of the cage to the frame is such that it can also be used not only with a frame designed for use with shorter roller covers, but also with a frame designed for use with longer roller covers (for example a 9" cover and cage assembly that can be used with both 6.5" and 9" frames).

More specifically, in one presently preferred embodiment, the cage is formed of two coaxial tubes formed of a relatively rigid and lightweight engineering or commodity plastic material such as Acrylonitrile butadiene styrene (ABS) or Polypropylene (PP), namely, a tubular outer support having a nominal diameter of 1" and a tubular inner chassis having a nominal diameter of 0.5", with the tubular inner chassis connecting an end support bearing and a central support bearing which are each molded of a suitable plastic such as polypropylene (PP) and which each have not only a respective axial bore that functions as a rotating bearing surface about the frame axle, but also a respective bushing chamber that defines a pair of opposing radial bearing surfaces for axially constraining a tubular bushing that frictionally engages the axle, thereby maintaining the cover and cage at a desired fixed location on the axle. The tubular outer support not only is supported by and covers substantially all of the end support bearing and the central support bearing, but also preferably extends beyond the central support bearing to a molded closed end piece which covers and extends slightly beyond the open end of the tubular outer support, thereby permitting the roller cover assembly to be used in a corner between two walls, with a paint loaded roller cover being in contact with one wall, and the second end support providing a paint free surface in contact with the second wall. To better facilitate accurate tracking and rotation, the two axial bores extend outwards from either end of the tubular inner chassis, with the two bushing chambers further inside the tubular inner chassis and oriented opposite each, whereby the longitudinal spacing of the axial bearing surfaces defined in the bores is substantially greater than that of the radial bearing surfaces defined in the bushing chambers. Moreover, the relatively thin side walls of the bushing chambers (which are further weakened by a lateral opening through which the bushing is inserted) are reinforced and maintained in their proper position and orientation by the inner diameter of the tubular inner chassis.

In accordance with certain method aspects of the invention, the tubular bushings are each placed into its respective bushing chamber, which is externally dimensioned so as to be constrained radially when placed inside the tubular inner chassis to thereby help maintain the radial bearing surfaces in close alignment relative to the bushings. The bore of the tubular inner chassis is then glued or solvent welded at each end to a respective outer circumference of the bushing chamber walls, thereby not only maintaining the two supports at a desired spacing, but also maintaining the internal radial bearing surfaces in their proper position, to thereby form a simple but accurate bearing assembly that is adapted to be conveniently frictionally attached to and removed from the axle of the roller frame. The thus partially assembled bearing is then inserted into one end of the tubular outer support, with the central support at the second end of the tubular inner chassis preferably approximately at the mid point of the tubular outer support, and a closed end support is inserted into the second end of the tubular outer support.

BRIEF DESCRIPTION OF THE DRAWING

For a more complete understanding of the present invention, reference is now made to the following descriptions taken in conjunction with the accompanying drawing, in which.

DETAILED DESCRIPTION OF THE INVENTION

Figure 1:
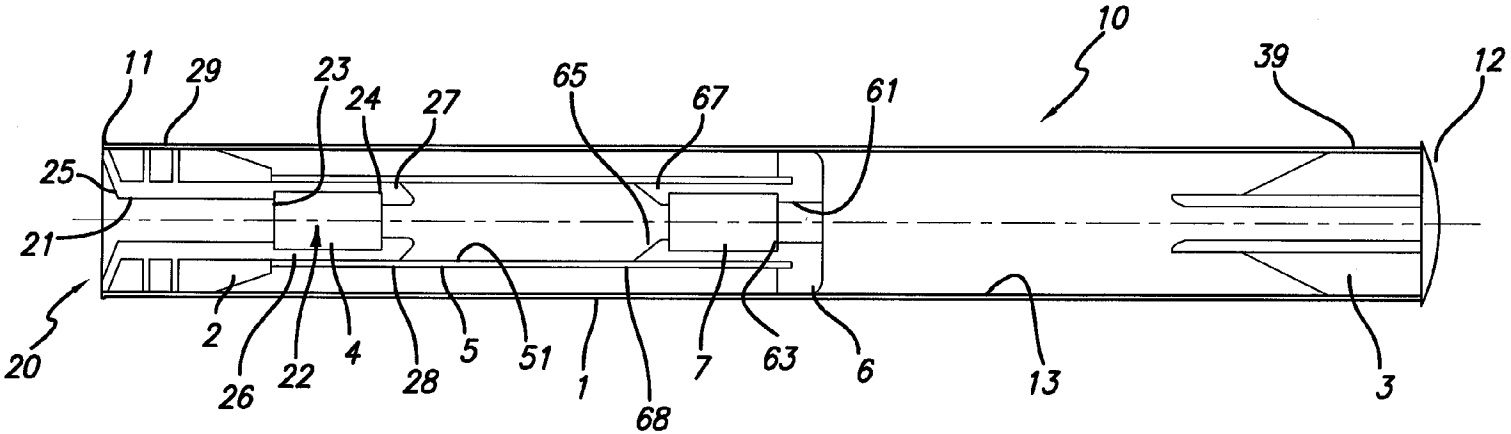
FIG. 1 is a cross-sectional view of a paint roller bearing cage assembly in accordance with this invention, upon which may be mounted a conventional fabric or foam roller cover.
Figure 2:
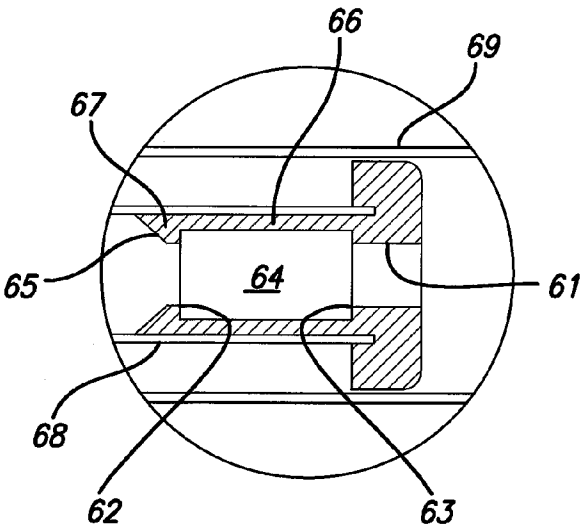
FIG. 2 is a cross-sectional close up view of a center support bearing for the assembly of FIG. 1.

Referring to FIGS. 1 and 2, a paint roller cover bearing cage assembly 10 of this invention is shown. The cage assembly 10 is generally cylindrical in shape, and as illustrated may for example be used with a conventional (either foam or napped fabric) paint roller cover (not shown) with a nominal length of 9" and a nominal internal diameter of 1", although other embodiments (not shown) may be constructed with other diameters (for example 1.5", 1.25", 0.5" or 0.25") and other lengths (for example 6.5" or 13"). In various presently preferred embodiments, the flexible roller cover material (either a napped fabric or a flocked foam) is permanently attached in conventional fashion to mounting assembly 10 to form a single disposable unit. Alternatively, the cover material can be formed into an outer sleeve that conveniently slides onto and off of cage assembly 10, thereby permitting the cage assembly to be recycled for use with a new cover.

The cage assembly 10 is designed to fit onto the 6 mm (approximately 0.25") diameter by 8.5" long axle portion (not shown) of a conventional rod frame (or optionally, onto a shorter and lighter weight frame that is typically used with 6.5" covers), and consists of a tubular outer support 1 which may for example be an appropriate length of 1.0" diameter ABS or PP tubing, supported at one end by an end bearing assembly 20 containing one or more tubular split ring bushings 4,7. In one specific embodiment (not shown) optimized for efficient application of paint to a smooth interior surface, the outer support 1 is cut from a standard length of 1.25" tubing about which has been previously spirally wound a 1.5" wide ribbon of 0.25" thick napped fabric. The other end of tubular outer support 1 supports a closed end piece 3 which may for example be molded from PP or other precision moldable structural plastics. The cage assembly 10 is frictionally locked onto the axle portion of the rod frame (not shown) by the tubular split ring bushings 4,7 (or other frictionally positionable bushings) of the end bearing assembly 20.

Referring now to FIG. 1, it will be seen that end bearing assembly 20 inside tubular sleeve 1 is constructed on a tubular inner chassis 5 that is also cut from a length of relatively rigid and lightweight tubing formed from an engineering or commodity plastic such as ABS or PP, but is less than half as long as outer sleeve 1 (for example, about 3") and approximately half the diameter (for example, about 0.5"). Tubular inner chassis 5 supports at one end an end support bearing 2 and at the other end, a central support bearing 6, thereby providing an assembly that is both light and strong. The two support bearings 2,6 are preferably each molded of a suitable commodity plastic such as PP, and each have not only a respective axial bore 21,61 that provides a rotating bearing about the frame axle but also (as best seen in FIG. 2) a respective bushing chamber 22,62 that defines a pair of opposing radial bearing surfaces 23,24;63,64 such that the chamber 22,62 has an internal length that is only slightly (0.003"±002") longer than the inserted tubular bushings 4,7 that frictionally engages the axle, thereby axially maintaining the cover and cage at a desired fixed location on the axle within a tolerance of 0.005". The axial bore 61 of central support bearing 6 is preferably located approximately in the middle of tubular sleeve 1, thereby permitting a shorter frame with a shorter axle portion, e.g. 5" to 6", to be used, but still maintaining a sufficient distance between the two axial bearing surfaces 21,61 to prevent unwanted twisting movement of the bearing assembly 20 relative to the axle passing through them. In order to facilitate the convenient installation of bearing assembly 20 onto the axle, the outer end of end bearing support 2 has an inwardly tapered entrance 25 leading into bore 21.

Referring now specifically to FIG. 2, it will be seen that the length of bushing chamber 62 is defined by a thin sidewall 66 that is integrally molded with the other components of support bearing 6 and extends length of chamber 62 from first radial bearing surface 63 surrounding bore 61, with an inwardly projecting lip 67 at the other end of chamber 62 for supporting the second radial bearing surface 64. The open portion of sidewall 66 defines a lateral opening through which bushing 7 may be inserted into chamber 62, and the outer circumference of sidewall 66 preferably has diameter approximately equal to the inner diameter 51 of tubular inner chassis 5, such that wall 66 is constrained radially in its proper position when placed inside the tubular inner chassis 5. Similar to tapered entrance 25, the portion of lip 67 that faces end support bearing 2 is provided with a tapered ramp 65 for guiding the axle as it is being inserted into the central bearing support 6 of bearing assembly 20.

Referring again to FIG. 1, wall 26 surrounding first chamber 22 may be constructed and dimensioned in the same fashion and to the same tolerances as wall 66 of second chamber 62, and include a similarly spaced radial bearing surface 24 on inwardly projecting lip 27, and a similarly dimensioned outer circumference 28.

The tubular outer support 1 not only covers substantially all of the end support bearing 2 and the central support bearing 6, but also preferably extends beyond the central support bearing 6 to a molded closed end piece 3 which covers and extends slightly beyond the end 11 of tubular outer support 1 remote from bearing assembly 20, thereby permitting the roller cover assembly 10 to be used in a corner between two walls, with a paint loaded roller cover being in contact with one wall, and the closed end piece providing a paint free surface in contact with the second wall. Preferably, end piece 3 is provided with a bore portion 31 which provides an additional bearing surface (and thus even more support and stability) when cage 10 is used with a large frame having an axle that extends almost the entire length of tubular outer support 1.

The outer surfaces 29,39 of end support bearing 2 and end piece 3 each preferably have a diameter that is somewhat greater than the diameter of the inner surface of tubular outer support 1, whereby bearing assembly 20 and end piece 3 are frictionally held inside tube 1, with at least end support bearing 2 preferably incorporating integrally molded grooves, fins, and/ridges to better maintain bearing assembly 20 in a fixed position relative to tubular outer support 1. Since inner tubular chassis preferably rigidly secures central support bearing 6 to end support bearing 2 which in turn has an interference fit inside outer tubular chassis 5, it is not necessary for central support bearing 6 to itself have an interference fit inside outer tubular support 1, but rather it has approximately the same diameter as the inner diameter of outer tubular support 1 (a so-called "snug fit), thereby not only providing an accurate radial positioning of the bore 61, but also avoiding excessive frictional forces which could otherwise not only interfere with the assembly process, but which in an extreme case could even cause distortion of the bushing chambers and possible interference between radial bearing surfaces 23,24;63,64 and the contained bushings 4,7.

A presently preferred method of assembling the paint roller cage 10 of FIG. 1 will now be described. First, the tubular bushings 4,7 are each placed into its respective bushing chamber 22,62, with the outer circumference 28,68 of walls 26,66 being constrained radially and made more rigid when the respective support bearing 2,6 is inserted into a respective end of the tubular inner chassis 5. The bore 51 of the ABS tubular inner chassis 5 is preferably secured by conventional means (for example, solvent welding, but possibly also other means such as friction, adhesives, solvents, ultrasound, heat, interleaved corrugations and/or mechanical fasteners) at each end to the respective outer circumference 28,68 of the bushing chamber walls 25,65, thereby not only maintaining the two supports 2,6 and their included bores 21,61 at a desired spacing, but also maintaining their respective walls 25,65 and bearing surfaces 24,64 of lips 27,67 in their proper operative position, to thereby form a simple but accurate bearing assembly 20 that is adapted to be conveniently frictionally attached to and removed from the axle of the roller frame (not shown). The thus assembled bearing assembly 20 is then guided into one end 11 of the tubular outer support 1, with the central support 6 at the second end of the tubular inner chassis 5 approximately at the mid point of the tubular outer support 1, and once so aligned, is forcefully pressed in until contact is made with the first end 11 of tubular outer support 1. Finally, the closed end support 3 is inserted into the second end 12 of the tubular outer support 1.

Although the present invention has been described in connection with the preferred embodiments, it is to be understood that modifications and variations may be utilized without departing from the principles and scope of the invention, as those skilled in the art will readily understand. For example, by appropriate reductions of the outer diameters 29,69,39, the inner diameter 13, the wall circumferences 28,68, and the inner diameter 13 (and perhaps by using a smaller tubular bushing 4,7 sized to fit a smaller roller frame axle), the salient features of the present invention may be adapted for use with smaller diameter (0.5" or even 0.25") paint rollers. Accordingly, such modifications may be practiced within the scope of the following claims.

The invention claimed is:

1. A paint roller bearing cage, adapted for receiving an axle portion of a paint roller frame, said cage comprising:

a tubular outer support;

an end support bearing at a first end portion of the outer support;

a central support bearing in a middle portion of the outer support;

a tubular inner chassis for securing the central support bearing a predetermined longitudinal spacing from the end support bearing; and a pair of tubular bushings adapted to frictionally engage said axle portion;

wherein each of said support bearings further comprises an integrally molded axial bore for providing an axial bearing surface for radially constraining said axle portion, and an integrally molded bushing chamber defined by a sidewall connecting first and second radial bearing surfaces for axially constraining a respective one of said tubular bushings wherein said tubular bushings are located in respective bushing chambers;

wherein said first radial bearing surface extends radially outwards from said axial bore and said second radial bearing surface is defined on an enlarged inwardly projecting lip extending radially inwards from said sidewall; and said tubular inner chassis is suspended inside said tubular outer support with an outer circumference of said semi-cylindrical sidewall in contact with an inner diameter of the tubular inner chassis and an outer diameter of the respective support bearing in contact with an inner diameter of the tubular outer support.

2. The paint roller bearing cage of claim 1, wherein said tubular outer support has a maximum diameter of not more than about 1.25 inch.

3. The paint roller bearing cage of claim 2, wherein the tubular outer support has a nominal diameter of about one inch.

4. The paint roller bearing cage of claim 2, wherein the tubular outer support has a length of about 9 inches.

5. The paint roller bearing cage of claim 1 further comprising a closed end piece at a second end of the outer tubular support, said closed end piece further comprising a bore portion for providing additional bearing support when the cage is used with a paint roller frame having an axle that extends almost the entire length of said tubular outer support.

6. The paint roller bearing cage of claim 1, wherein the axial bore of said end support bearing, the second radial bearing surface of said central support bearing, and the bore portion of said closed end piece are each provided with a tapered ramp for guiding the cage onto the axle.

7. A paint roller bearing cage, adapted for receiving an axle portion of a paint roller frame, said cage comprising:

a tubular outer support;

an end support bearing at a first end portion of the outer support;

a central support bearing in a middle portion of the outer support;

a tubular inner chassis disposed entirely within the tubular outer support for mechanically coupling the central support bearing to the end support bearing with a predetermined longitudinal spacing;

a pair of tubular bushings adapted to frictionally engage said axle portion; and a closed end piece at a second end portion of the outer support and further comprising a bore portion for providing additional bearing support when the cage is used with a paint roller frame having an axle that extends almost the entire length of said tubular outer support;

wherein each of said support bearings further comprises an integrally molded axial bore for providing an axial bearing surface about said axle portion, and an integrally molded bushing chamber for axially constraining a respective one of said tubular bushings, with the axial bore extending outwards from a respective end of the inner tubular chassis and the bushing chamber disposed inside the inner tubular chassis, whereby the longitudinal spacing between the two axial bores is greater than that of the two bushing chambers wherein said tubular bushings are located in respective bushing chambers;

wherein said first radial bearing surface extends radially outwards from said axial bore and said second radial bearing surface is defined on an enlarged inwardly projecting lip extending radially inwards from said sidewall; and said tubular inner chassis is suspended inside said tubular outer support with an outer circumference of said sidewall in contact with an inner diameter of the tubular inner chassis and an outer diameter of the respective support bearing in contact with an inner diameter of the tubular outer support.

* * * * *